US006510668B2

(12) United States Patent
Kim

(10) Patent No.: US 6,510,668 B2
(45) Date of Patent: Jan. 28, 2003

(54) DRUM OF MEDICINE SHARING AND PACKING DEVICE

(75) Inventor: June Ho Kim, Daegu (KR)

(73) Assignee: JV Medi Co., Ltd., Daegu (KR)

( * ) Notice: Subject to any disclaimer, the term of this patent is extended or adjusted under 35 U.S.C. 154(b) by 0 days.

(21) Appl. No.: 09/964,353

(22) Filed: Sep. 28, 2001

(65) Prior Publication Data

US 2002/0100764 A1 Aug. 1, 2002

(30) Foreign Application Priority Data

Jan. 26, 2001 (KR) ..... 2001-0001879

(51) Int. Cl.[7] ..... B15B 35/54

(52) U.S. Cl. ..... 53/154; 53/237; 221/119; 221/130

(58) Field of Search ..... 221/119, 120, 221/123, 124, 129, 130, 131, 133, 281, 93, 94; 53/154, 237

(56) References Cited

U.S. PATENT DOCUMENTS 6,427,865 B1 * 8/2002 Stillwell et al. ..... 221/4

* cited by examiner

*Primary Examiner*—Donald P. Walsh
*Assistant Examiner*—Daniel K Schlak
(74) *Attorney, Agent, or Firm*—Jacobson Holman PLLC

(57) ABSTRACT

A drum of a medicine sharing and packing device wherein a plurality of tablet cassettes 1*a* are arranged and passages are formed to guide tablets down, comprises a barrel-shaped drum body 1*c* formed in two circular arc shapes facing each other and auxiliary drums 1*e* mounted on the inner sides of opening portions 1*d* of the drum body 1*c*. The drum body 1*c* has the opening portions 1*d* formed on both sides facing each other and a plurality of tablet cassettes 1*a* are arranged detachably on the outer circumferential surface of the drum body 1. A plurality of tablets cassettes 1*a* are also arranged detachably on the circumferential surfaces of the auxiliary drums 1*e*.

4 Claims, 3 Drawing Sheets

DRUM OF MEDICINE SHARING AND PACKING DEVICE

BACKGROUND OF THE INVENTION

The present invention relates to a drum which is used in a medicine sharing and packing device designed to distribute and pack a variety of tablets per dose, and more particularly, a drum for a medicine sharing and packing device which facilitates attachment and detachment of tablet cassettes containing tablets and allows the number of tablet cassettes to be increased simply.

In general, a medicine sharing and packing device denotes a machine designed to automatically distribute a variety of tablets prescribed for a patient's disease and pack them dose by dose.

For the above medicine sharing and packing device, a plurality of tablet cassettes containing a variety of tablets are arranged on a drum, individual tablet cassettes are intermittently controlled to discharge tablets prescribed dose by dose to the downside through passages provided at a drum, and tablets discharged from the drum are gathered into a hopper, discharged down under the hopper, and put into a packing sheet for packing.

A conventional drum, as disclosed in my Utility Model Registration Application No. 14638, 1998, comprises a barrel-shaped drum body with opening portions formed on both sides facing each other, and auxiliary drums which are mounted inside of the drum body which is divided by the opening portions.

In other words, the drum body is in two circular arc shapes facing each other without coming into contact with each other, and the auxiliary drums are mounted inside of the drum body so as to face each other in the state of the opening portions being open to enable a user to change tablet cassettes through them.

Of course, a plurality of tablet cassettes are arranged on the circumferential surface of the drum body and auxiliary drums, and tablets in the tablet cassettes are dropped through passages formed in the drum.

Therefore, the conventional drum is so structured that, as noted above, auxiliary drums are mounted inside of the drum body to accommodate a plurality of additional tablet cassettes, thereby allowing various kinds of tablets to be distributed and packed.

For the conventional drum, it is difficult to change tablet cassettes which are located in the central part of the drum body since the auxiliary drums are mounted on both sides with the opening portions of the drum body being not closed and accordingly the position of the tablet cassettes installed in the auxiliary drums differs.

When changing tablet cassettes in the central part of the drum body, it is possible to change tablet cassettes of an auxiliary drum at one opening portion while changing them at the other opening portion. In this case, a user may not want to rotate the drum body and so continue changing table cassettes at one opening portion. Then, the changing work may not be performed properly.

Further, there is a disadvantage that it is impossible to increase the number of tablet cassettes to be mounted because a small portion of the space formed inside of the drum is available for use.

SUMMARY OF THE INVENTION

The present invention is contrived to overcome the conventional disadvantages described above. Therefore, it is an object of the present invention to provide a drum of a medicine sharing and packing device, wherein the position of tablet cassettes to be arranged on auxiliary drums mounted inside of a drum body can be changed to a position near a user or worker by means of power and the number of tablet cassettes to be mounted on the auxiliary drums can be increased, thereby facilitating attachment and detachment of table cassettes containing tablets and allowing the number of tablet cassettes to be increased simply.

To achieve the above-described object, a drum of a medicine sharing and packing device designed to pack tablets prescribed dose by dose, wherein a drum is mounted so as to be rotated and has a plurality of tablet cassettes arranged and passages formed to guide tablets down, comprises a barrel-shaped drum body with opening portions formed on both sides facing each other and a plurality of tablet cassettes arranged detachably on the outer circumferential surface, and two barrel-shaped auxiliary drums mounted in the inside of the opening portions of the drum body and having a plurality of tablet cassettes arranged detachably on their circumferential surfaces.

DETAILED DESCRIPTION OF THE PREFERRED EMBODIMENTS

With reference to the accompanying drawings, the present invention will now be described.

Figure 1:
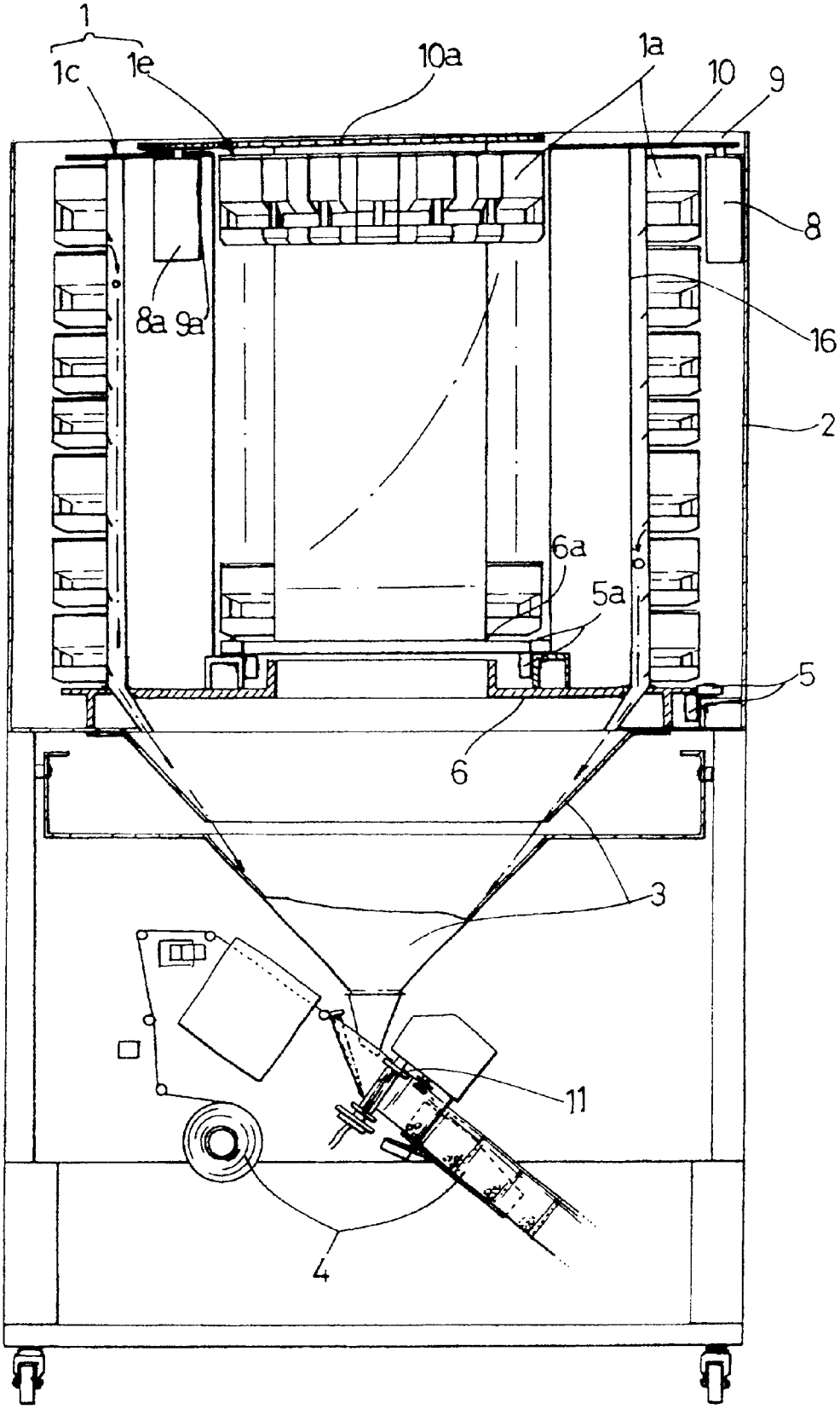
FIG. 1 is a partial cross-sectional view of a medicine sharing and packing device to which a drum according to the present invention applies.

FIG. 1 shows a medicine sharing and packing device to which a drum according to the present invention applies. The medicine sharing and packing device is so structured that a drum 1 having a plurality of tablet cassettes 1*a* is mounted inside of a case 2 so as to be rotated, a double-layer hopper 3 is mounted under the drum 1, and a packing means for packing tablets, dropped from the hopper 3 dose by dose, using a packing sheet 4, is provided.

For the drum 1 a plurality of tablet cassettes 1*a* are arranged and passages 1*b* are formed to guide tablets down.

Figure 2:
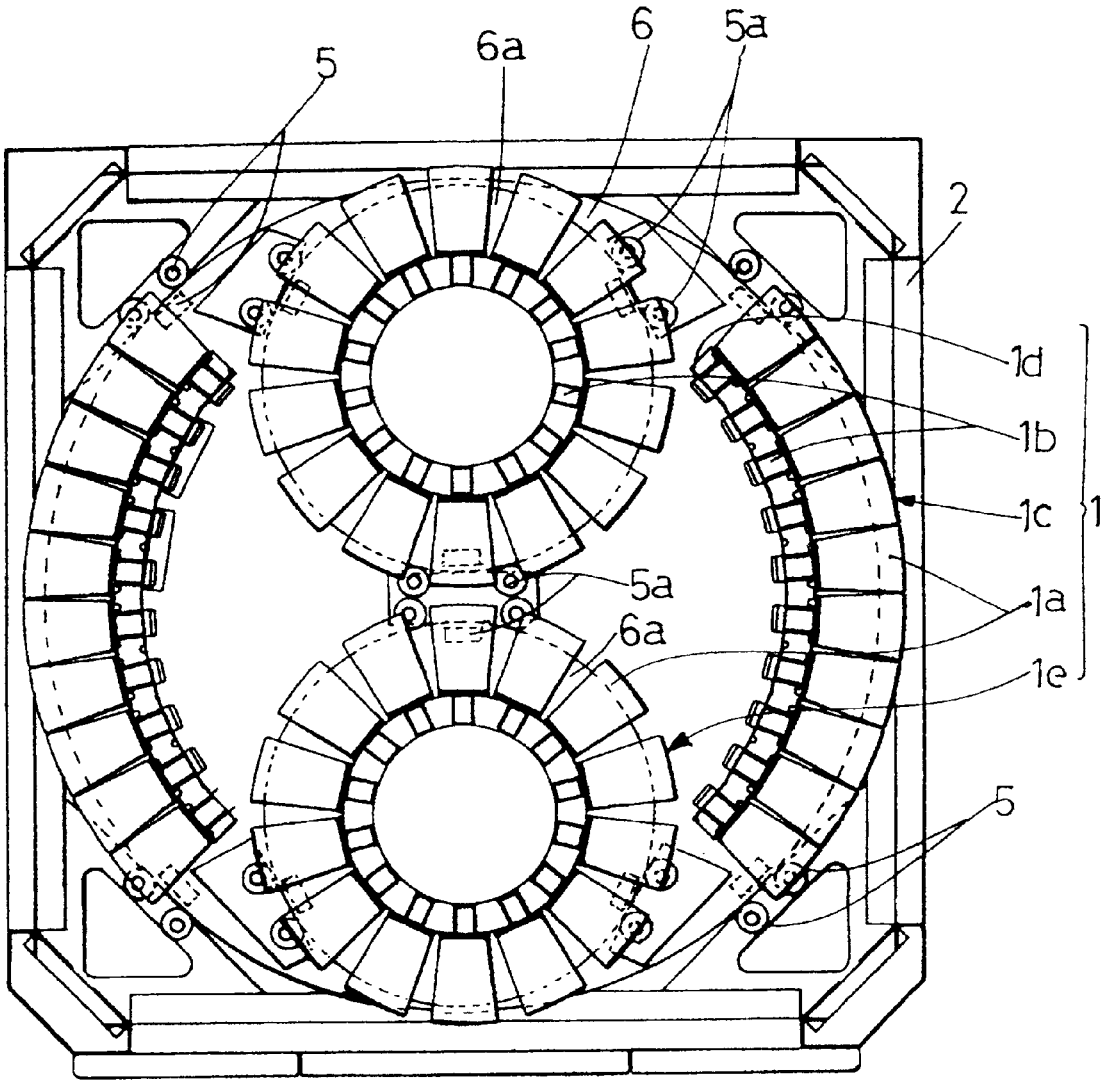
FIG. 2 is a transverse section of a drum of a medicine sharing and packing device according to the present invention.

As illustrated in FIGS. 1 and 2, the drum 1 according to the present invention, comprises a barrel-shaped drum body 1*c* formed in two circular arc shapes facing each other and auxiliary drums 1*e* mounted on the inner sides of opening portions 1*d* of the drum body 1*c*.

The drum body 1*c* has the opening portions 1*d* formed on both sides facing each other and a plurality of tablet cassettes 1*a* arranged detachably on the outer circumferential surface, and the auxiliary drums 1*e* formed in the barrel shape have a plurality of tablet cassettes 1*a* arranged detachably on their circumferential surfaces.

Of course, a plurality of passages 1*b* are provided to guide tablets down from the tablet cassettes 1*a* of the drum body 1*c* and auxiliary drums 1*d*.

As illustrated in FIGS. 1 and 2, a rotary plate 6 is mounted under the drum 1, that is, the drum body 1*c*. The edge portion and circumferential surface of the rotary plate 6 are supported by a plurality of rollers 5. As illustrated in FIGS.

1 and 3, a gear plate 10 is mounted over the drum 1, that is, the drum body 1*c*. The gear plate 10 is supported by a plurality of idle gears 7 and engaged with a driving gear 9 driven by a motor 8.

Figure 3:
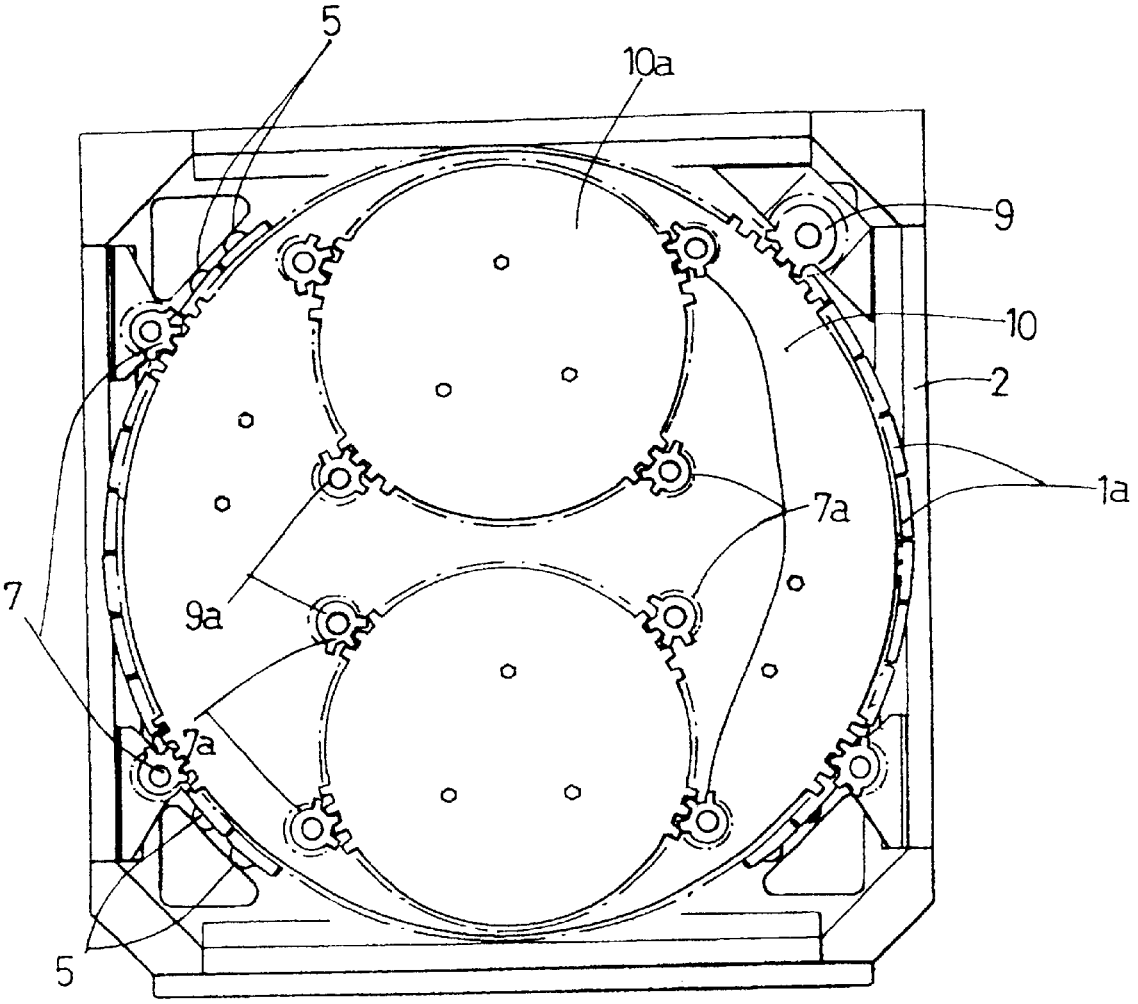
FIG. 3 is a transverse section showing a driving means for a drum of a medicine sharing and packing device according to the present invention.

Further, as illustrated in FIGS. 1 and 2, a rotary plate 6*a* is mounted under the auxiliary drums 1*e*. The edge portion and circumferential surface of the rotary plate 6*a* are supported by a plurality of rollers 5*a* so as to be rotated. As illustrated in FIGS. 1 and 3, a gear plate 10*a* is mounted over the auxiliary drums 1*e*. The gear plate 10*a* is supported by a plurality of idle gears 7*a* and engaged with a driving gear 9*a* driven by a motor 8*a*.

In this embodiment, rollers 5*a* are mounted on the rotary plate 6. The rollers 5*a* support the auxiliary drums 1*e* so as to be rotated.

As disclosed previously, a packing sheet 4, which is folded in the direction of width, travels at the lower outlet of the hopper 3, a pair of heating rollers 11 are mounted to seal the folded packing sheet in both directions of length and width, and a plurality of tablet cassettes 1*a* mounted in the drum 1 are actuated by an electrical signal to discharge contained tablets one by one.

In the drum constructed as described above, tablets contained in the tablet cassettes 1*a* are dropped down by the operation of the tablet cassettes 1*a* into the hopper 3 through passages 1*b,* discharged down after being gathered into the hopper 3, and packed and sealed dose by dose by the heating rollers 11.

When the tablet cassettes 1*a* become empty, they should be detached to fill them with tablets. In this case, tablet cassettes 1*a* on the circumferential surface of the drum body 1*c* are changed as conventional, and tablet cassettes 1*a* on the circumferential surfaces of the auxiliary drums 1*e* can be changed easily through the opening portions 1*d* of the drum body 1*c* by driving the motor 8 and situating the table cassettes 1*a,* which are to be changed, at the opening portions 1*d* of the drum body 1*c*.

Of course, the drum body 1*c* is also easily rotated by the motor 8 and a plurality of rollers 5, so that the tablet cassettes 1*a* mounted on the circumferential surface of the drum body 1 is situated in front of a worker or user to facilitate the change of the tablet cassettes 1*a*.

Accordingly, the drum of a medicine sharing and packing device according to the present invention facilitates the change of a plurality of the tablet cassettes 1*a* located in the drum body 1*c* and auxiliary drums 1*e,* and allows the number of the tablet cassettes 1*a* located on the circumferential surface of the auxiliary drums 1*e* to be increased simply.

As discussed above, the drum of a medicine sharing and packing machine according to the present invention allows tablet cassettes arranged on auxiliary drums mounted inside of a drum body to be located in front of a user or worker, thereby facilitating the attachment and detachment of table cassettes containing tablets.

Further, it is easy to increase the number of tablet cassettes to be mounted on the entire drum since it is possible to increase the number of tablet cassettes which are to be mounted on the auxiliary drums.

What is claimed is:

1. A drum of a medicine sharing and packing device designed to pack tablets prescribed dose by dose, wherein said drum is mounted to rotate and has a first and second plurality of tablet cassettes arranged with passages formed to guide tablets down, comprising a barrel-shaped drum body with opening portions formed on an inner circumferential surface of said drum body and facing each other, said first plurality of tablet cassettes detachably arranged on said inner circumferential surface between said opening portions, and two barrel-shaped auxiliary drums mounted inside of said opening portions of said drum body and said second plurality of tablet cassettes detachably arranged on outer circumferential surfaces of said two barrel-shaped auxiliary drums.

2. The drum as recited in claim 1, comprising a rotary plate mounted under said drum.

3. The drum as recited in claim 2, comprising a plurality of rollers for supporting said rotary plate.

4. The drum as recited in claim 1, comprising a gear plate mounted over said drum.

* * * * *